US005079588A

United States Patent [19]

Ohira et al.

[11] Patent Number: 5,079,588

[45] Date of Patent: Jan. 7, 1992

[54] MOVABLE SCANNING SYSTEM RESPONSIVE TO PLATEN COVER POSTION AND OPERATION MODE

[75] Inventors: Tadashi Ohira; Syuzi Maruta, both of Osaka, Japan

[73] Assignee: Minolta Camera Kabushiki Kaisha, Osaka, Japan

[21] Appl. No.: 489,018

[22] Filed: Mar. 6, 1990

[30] Foreign Application Priority Data

Mar. 7, 1989 [JP] Japan ..... 1-54381

[51] Int. Cl.[5] ..... G03G 15/28

[52] U.S. Cl. ..... 355/235; 355/233; 355/313

[58] Field of Search ..... 355/55, 60, 61, 67, 355/71, 75, 232, 233, 235, 308, 313

[56] References Cited

U.S. PATENT DOCUMENTS

| | | | |
|---|---|---|---|
| 4,057,341 | 11/1977 | Sohm | 355/234 |
| 4,214,832 | 7/1980 | Kono et al. | 355/233 |
| 4,295,732 | 10/1981 | Hull et al. | 355/75 X |
| 4,299,478 | 11/1981 | Knodt et al. | 355/75 X |
| 4,403,850 | 9/1983 | Masuda | 355/313 |
| 4,505,575 | 3/1985 | Palumbo | 355/75 X |
| 4,523,831 | 6/1985 | Yokoo et al. | 355/231 |
| 4,739,376 | 4/1988 | Kanekol | 355/75 |

FOREIGN PATENT DOCUMENTS

| | | | |
|---|---|---|---|
| 0167159 | 12/1981 | Japan | 355/231 |
| 0029829 | 1/1989 | Japan | 355/231 |
| 0070735 | 3/1989 | Japan | 355/235 |

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

An electrophotographic copying machine is provided with a leaf document circulation mode (LDC mode) in which an optical scanner is fixed under a light transmission part of a platen glass and an original is made to pass over the optical scanning mechanism with an automatic document feeder mounted on the platen glass. To prevent the light-fatigue of the photosensitive drum caused by the light passing through the platen glass and incident on a photosensitive drum through an optical system when the automatic document feeder mounted on the platen glass is opened in the LDC mode, the open/-close condition of the automatic document feeder is detected with a sensor and when it is opened the optical scanner is moved to a position where the light incident through the platen glass does not strike upon the photosensitive drum.

17 Claims, 8 Drawing Sheets

MOVABLE SCANNING SYSTEM RESPONSIVE TO PLATEN COVER POSTION AND OPERATION MODE

BACKGROUND OF THE INVENTION

1. Field of the Invention

The present invention relates to an electrophotographic copying machine, to be particular, it relates to an electrophotographic copying machine having an operation mode in which a mirror scanner stops at a light transmission part of a platen glass being covered with a covering member such as an original holder, an automatic document feeder, etc.

2. Description of the Prior Arts

This kind of electrophotographic copying machine is, for example, described in U.S. Pat. No. 4,057,341. The machine has a mirror scan mode in which copying is performed by scanning an original image on a platen glass with a mirror scanner and a Leaf Document Circulation Mode (LDC mode) in which copying is performed by scanning an image while an original is conveyed on a platen glass and a mirror scanner is stopped at a light transmission part of the platen glass. During the period in which the LDC mode is set, the mirror scanner is moved to the light transmission part of the platen glass and it stays there keeping the state where copying is possible.

When an original being conveyed is jammed on the platen glass in the state where the LDC mode is possible, for the processing of the jam, a covering member such as the automatic document feeder or the original holder for covering the platen glass can be opened.

As the mirror scanner is made to position and stay at the light transmission part of the platen glass, if the covering member is opened, the mirror scanner catches the light incident on the platen glass. The light is led to a part of a photosensitive member through an exposure optical system including the mirror scanner and locally exposes the photosensitive member. Thus, local optical fatigue can occur in the photosensitive member; it can cause uneven electric charging in the following image formation, and furthermore it causes unevenness in the density of an image formed on a copyng paper.

SUMMARY OF THE INVENTION

A main object of the present invention is to provide a copying machine in which the light coming from the exterior, unnecessary for exposure, is not led to a photosensitive member.

Another object of the present invention is to prevent the light from being led to a photosensitive member by moving a scanner when a copying machine is put in a state where the external light can enter the scanner in the copying machine of a platen glass moving type.

A further object of the present invention is to shorten the rising time, a time duration from the issue of a copy-start signal until a copying operation is started.

Yet another object of the present invention is to provide a copying machine in which an unnecessary external light is not led to a photosensitive member, in the copying machine in which both mirror scan mode and LDC mode can be used.

A still further object of the present invention is that when a copying machine is to be brought to a state where a light is capable of entering the scanner from the outside due to a specified operation, the light is prevented from being led to a photosensitive member by an operation interlocking with the specified operation.

The other objects of the present invention will be made clear by the following description referring to the accompanying drawings.

DETAILED DESCRIPTION OF THE PREFERRED EMBODIMENTS

An embodiment according to the present invention will be described in the following.

Figure 1:
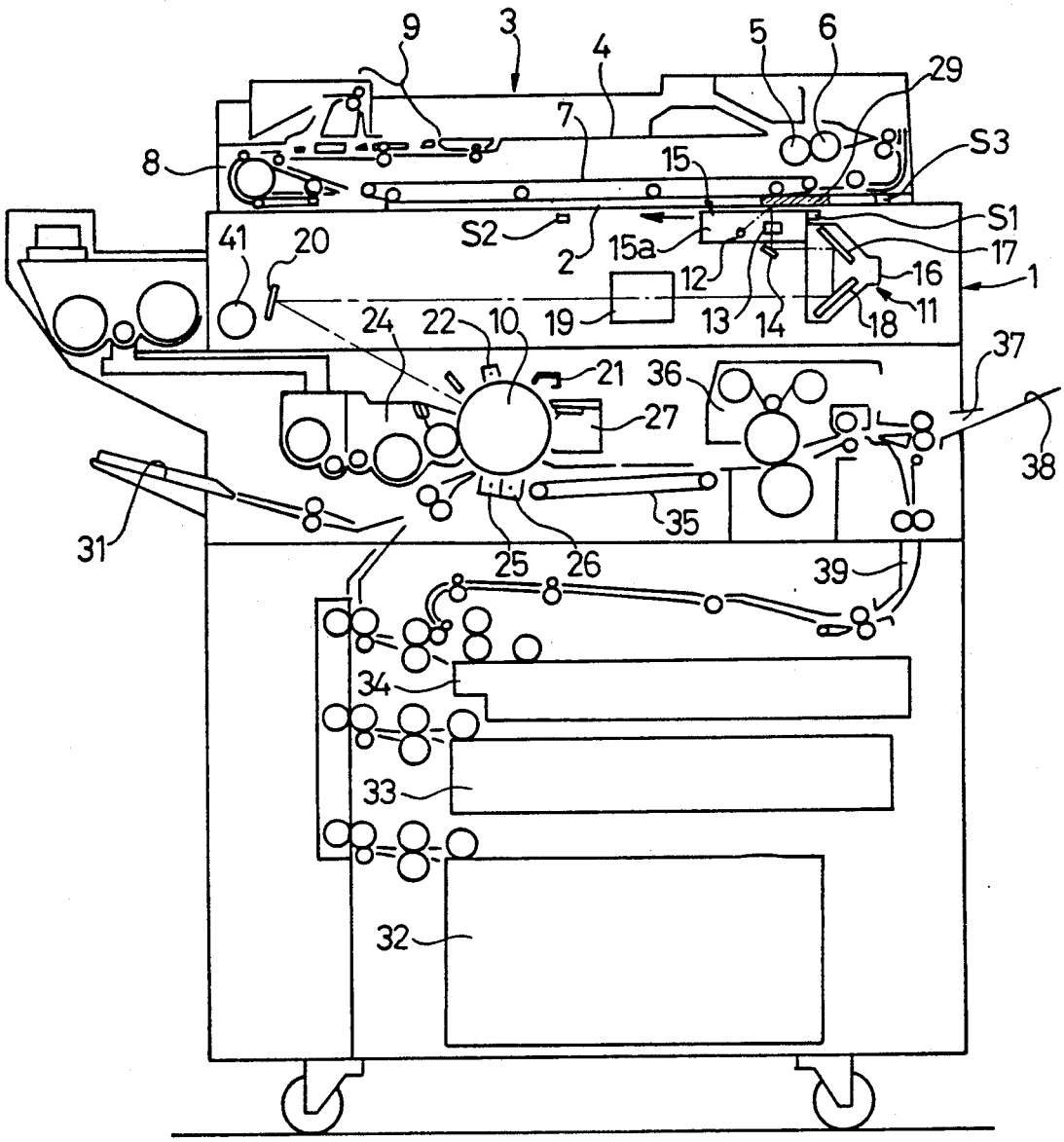
FIG. 1 shows a cross sectional view of the whole constitution of a copying machine in a mirror scan mode in an embodiment of the present invention.

FIG. 1 shows the whole constitution of an electrophotographic copying machine in the present embodiment. A body 1 has a transparent platen glass 2 in its upper part, and further on the platen glass 2 an automatic document feeder 3 of a circulating type is provided to be opened and closed. The automatic document feeder 3 is connected to the upper surface of the body 1 on its rear side using a hinge.

Figure 2:
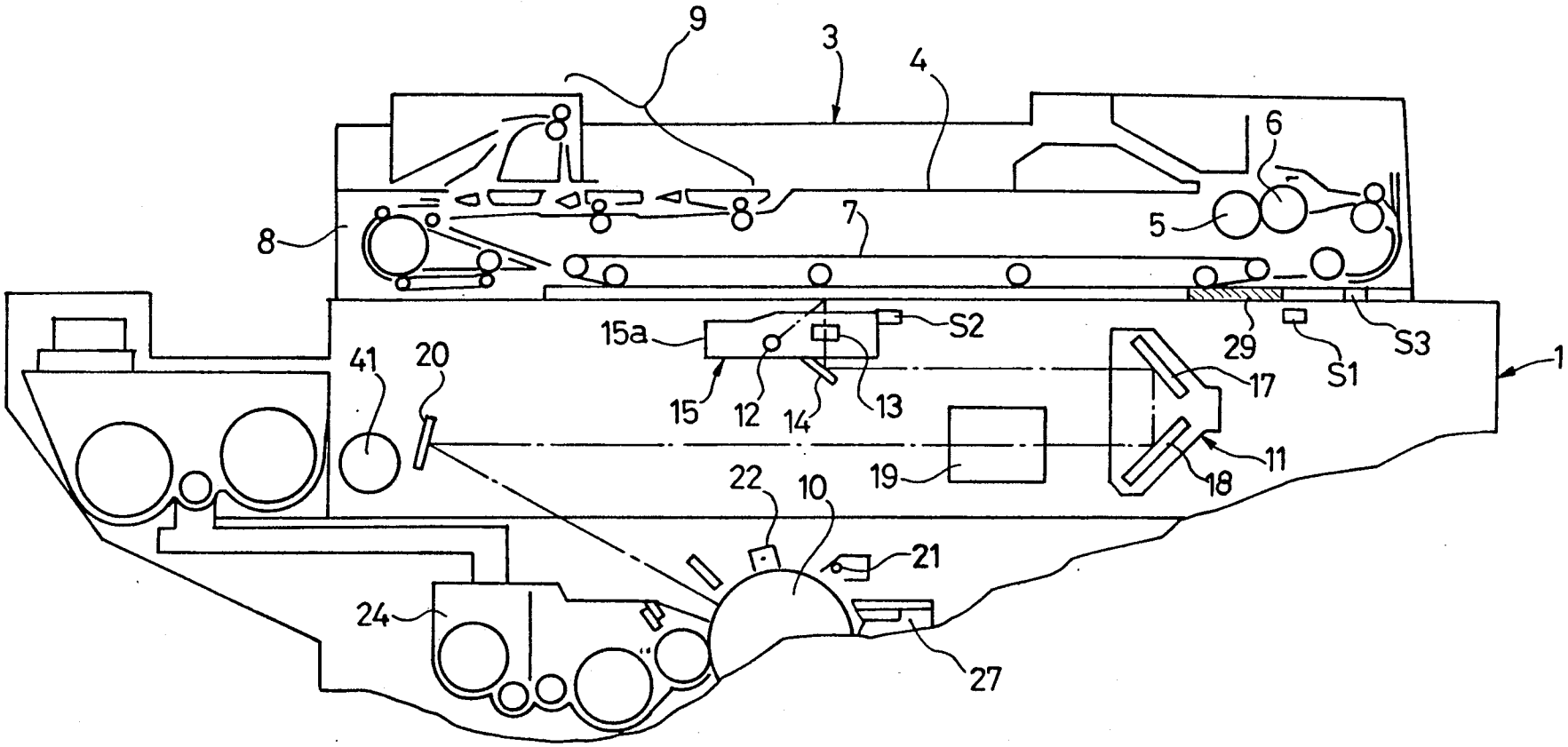
FIG. 2 is a cross sectional view showing a part of a copying machine in an LDC mode.
Figure 8:
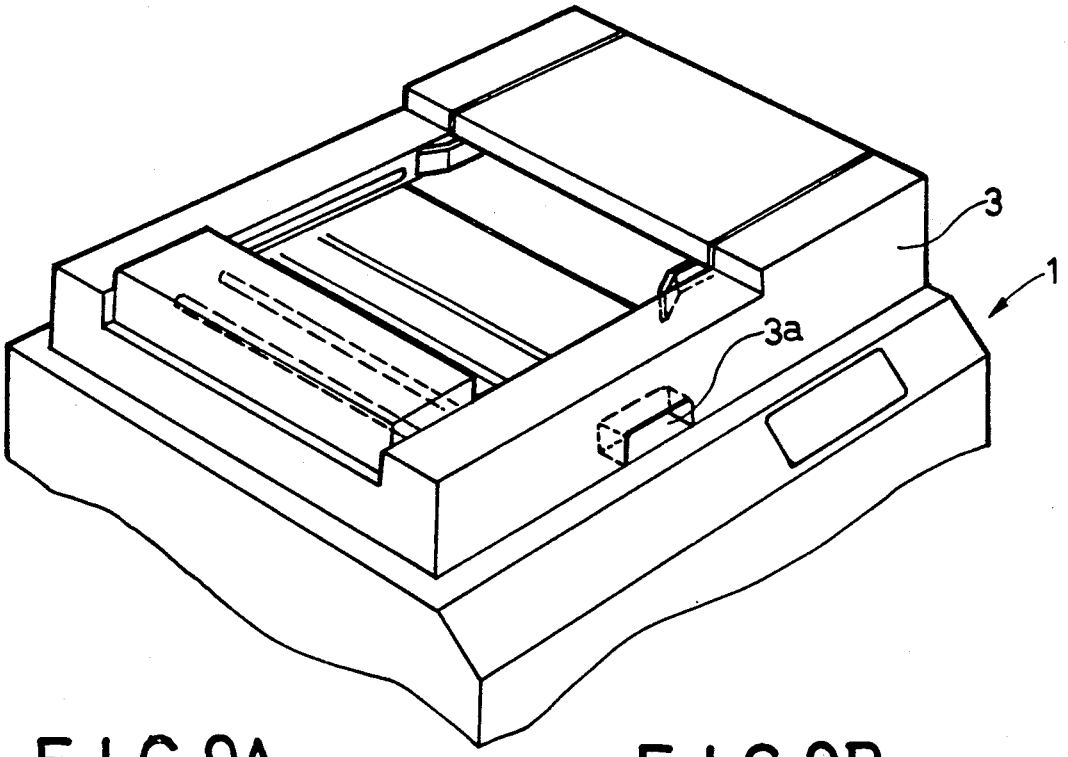
FIG. 8 is a perspective view showing an external appearance of an automatic document feeder provided on the upper part of the machine.
Figure 9A:
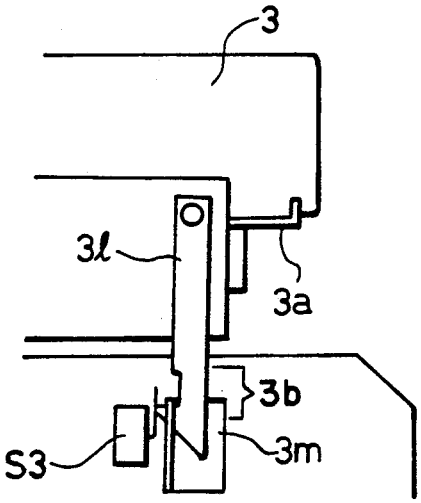
FIG. 9A is a cross sectional view of essential parts of a lock mechanism and an open/close sensor of the automatic document feeder in a locked state.
Figure 9B:
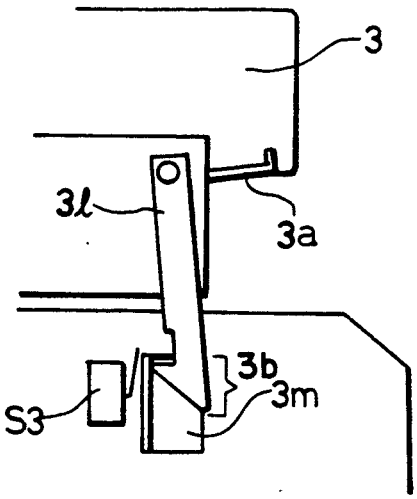
FIG. 9B is a cross sectional view of the essential parts mentioned in the above in an unlocked state.

The automatic document feeder 3 has an external appearance as shown in FIG. 8 and is provided with a handle 3*a* in the front center. In the vicinity of the handle, a lock mechanism 3*b* comprising a lock lever 3*l* and a lock piece 3*m* which locks the feeder 3 to the body 1 in the closed state of the feeder 3 as shown in FIGS. 9A and 9B. In the state where the automatic document feeder 3 is closed, the lock lever 3*l* and the lock piece 3*m* are in an engaged state as shown in FIG. 9A, and when the handle 3*a* is pulled upward, the lock lever 3*l* goes off from the lock piece 3*m* and is released as shown in FIG. 9B. A detection sensor S3 is provided in the vicinity of the lock mechanism 3*b* which is operated by the lock lever 3*l* for detecting the open/close condition of the feeder 3. It is also possible to detect the open/close state of the automatic document feeder 3 directly by the detection sensor S3 provided on the rear face of the automatic document feeder 3 as shown in FIG. 1 and FIG. 2.

The automatic document feeder 3 sends out an original set on an original setting tray 4 sheet by sheet from the bottom with a pickup roller 5 and a handling roller 6. The sent-out original is brought to a fixed place on the platen glass with a conveyor belt 7 which abuts the upper surface of the platen glass 2 for executing copying operation in the mirror scan mode, or the sent-out original is made to pass over the platen glass 2 for executing copying operation in the LDC mode. A sheet of original which has passed a copying process is led to a paper discharge and return section 8; at this section the surface and the back of a sheet of original is reversed, and it is again sent onto the platen glass 2 in collaboration with the conveyor belt 7 for a second copying in the case of double sided copying, or a sheet of original in the case of single sided copying or that which has finished double sided copying is returned as it is onto the original setting tray 4 through a paper discharging port 9.

Under the platen glass 2 in the body 1, an exposure-optical system 11 is provided and the image of an original sent onto the platen glass 2 is exposed on a photosensitive drum 10. The optical system 11 comprises: a mirror scanner 15 holding a light source 12, a slit 13 for exposure and a first movable mirror 14 on a first movable holder 15*a*, a second and a third movable mirrors 17 and 18 on a second movable holder 16, a projection lens 19 and a fourth fixed mirror 20.

In the mirror scan mode, the mirror scanner 15 is moved at a speed of V/n (V: a peripheral speed of the photosensitive drum 10, n: magnification) from the home position in the direction of an arrow as shown in FIG. 1 and scans an original on the platen glass 2. The second and the third movable mirrors 17 and 18 are moved at a speed of V/2n in the same direction to maintain the light path length at a constant value with the movement of the mirror scanner 15. In the LDC mode, the mirror scanner 15 is moved to a position shown in FIG. 2 and is stopped there and scans the image of the original by the movement of the original conveyed over the platen glass 2.

The projection magnification, when an original image is exposed on the photosensitive drum 10, can be changed by moving the projection lens 19 in the optical axis direction, with this movement the fourth fixed mirror 20 is moved a little for the compensation of the conjugate length.

Around the photosensitive drum 10 there are provided, in the order of rotating direction, a main eraser 21, an main charger 22, a developing unit 24, a transfer charger 25, a separation charger 26 and a cleaning device 27 to form an image forming section. In the image forming section, the remaining charge is at first removed from the surface of the photosensitive drum 10 by the main eraser 21, and then a uniform charge is given to the surface by the main charger 22, and after that the surface of the drum is exposed to form an electrostatic latent image corresponding to an original image. The electrostatic latent image is then developed by toner at the developing unit 24 to be a visual image, and it is transferred on a copying sheet by the transfer charger 25. The remaining toner is removed from the surface of the photosensitive drum 10 by the cleaning device 27, and then it is processed by the main eraser 21 and by the main charger 22 to be used for the exposure again.

A transferring section which is provided between the photosensitive drum 10 and the transfer charger 25 is so arranged that a copying sheet is fed from a manual insertion table 31 mounted outside the body 1, or from paper feeder sections 32 or 33 or from a paper re-feeder section 34 in the body 1. A toner image formed on the photosensitive drum 10 is transferred on the copying sheet which is fed to the transferring section, and after that the sheet is separated from the photosensitive drum 10 by the separation charger 26. The separated copying sheet is sent to a fixing device 36 with a conveyor belt 35, and toner image undergoes a fixing process. The fixing-processed copying sheet is discharged as it is onto a paper discharge tray 38 through a paper discharge port 37, or the sheet is sent to the paper re-feeder section 34 through a re-conveying path 39 after a copying process on one side.

The mirror scanner 15 and the second movable holder 16 are driven by a scanner motor 41. In the case of the mirror scan mode, usually the mirror scanner 15 is waited at a home position to be detected by a home position sensor S1 as shown in FIG. 1, and when it scans an original, it is once moved in the arrow direction by a distance corresponding to the size of a copy, and it is returned to the home position. When the LDC mode is set, the mirror scanner 15 is moved to a regular position in the LDC mode to be detected by a regular position sensor S2 in the LDC mode as shown in FIG. 2 and is stopped there.

In the above-mentioned home position, the first movable mirror 14, preparing for the mirror scanner 15, is situated under an original scale 29; in this position the mirror 14 does not pick up an external light incident on the platen glass 2 of the body 1.

In contrast with this, the regular position in the LDC mode is situated at a place where reflected rays from the original being conveyed over the platen glass 2 can be received, in other words it is situated at a light transmission part of the platen glass 2. Careful consideration is given to the above-mentioned position so that the projection lens 19 does not affect any interference such as abutting at any magnification position to the second movable holder 16 having the second and the third movable mirrors 17 and 18, the holder 16 which is moved with the movement of the mirror scanner 15.

When the automatic document feeder 3 is opened in the LDC mode, the sensor S3 generates a detection signal. In response to the detection signal, the mirror scanner 15 in the regular position is automatically moved to the home position where the mirror 14 does not pick up an external light incident on the platen glass 2. When the automatic document feeder 3 is closed in the LC mode, the mirror scanner 15 is automatically returned to the regular position in the LDC mode to be stopped there.

Figure 3:
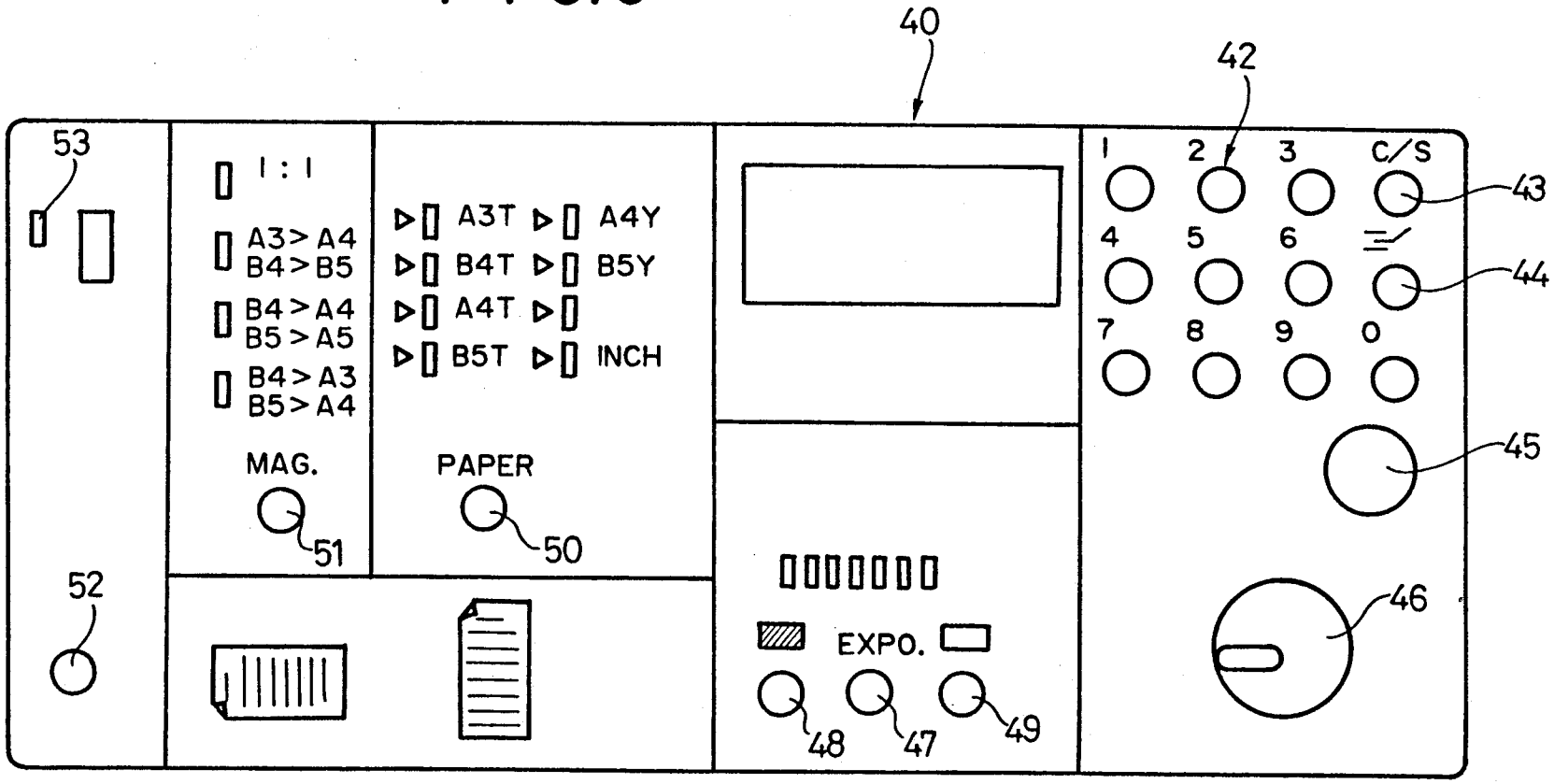
FIG. 3 is a plan view of a control panel.

FIG. 3 shows a control panel 40 on the body 1. The control panel 40 comprises a number key 42 for inputting the number of sheets to be copied, a clear/stop key 43, an interruption key 44, an all reset key 45, a print key 46, an image density automatic setting key 47, an image density up-adjusting key 48, an image density down-adjusting key 49, a paper size selection key 50, a magnification selection key 51, a mode switchover key 52 for selecting the mirror scan mode or the LDC mode, an LDC mode indication lamp 53, etc.

Figure 4:
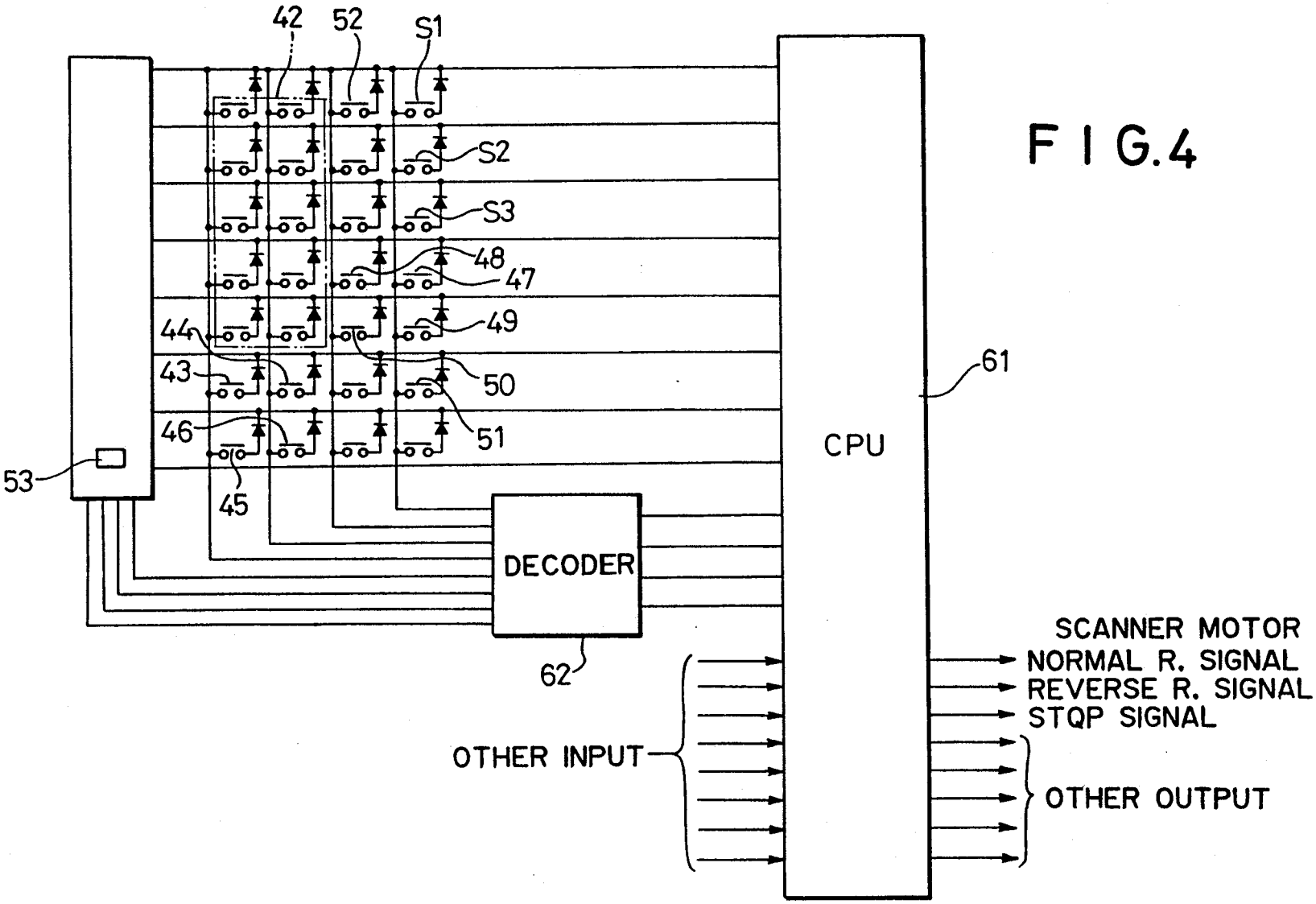
FIG. 4 is a control circuit diagram.

FIG. 4 shows a control circuit on the side of the body 1. To a CPU 61, in this control circuit, above-mentioned various kinds of input keys 42 to 52, an LDC mode indication lamp 53 and also the sensors S1 to S3 are inputted to the CPU 61 through a decoder 62. There are a signal line for the positive rotation of a scanner motor, a signal line for the negative rotation of the scanner motor, and a signal line for stop of the scanner motor in the output lines of the CPU 61.

Operation controls of the control circuit will be explained referring the flow charts shown in FIG. 5 to FIG. 7.

Figure 5:
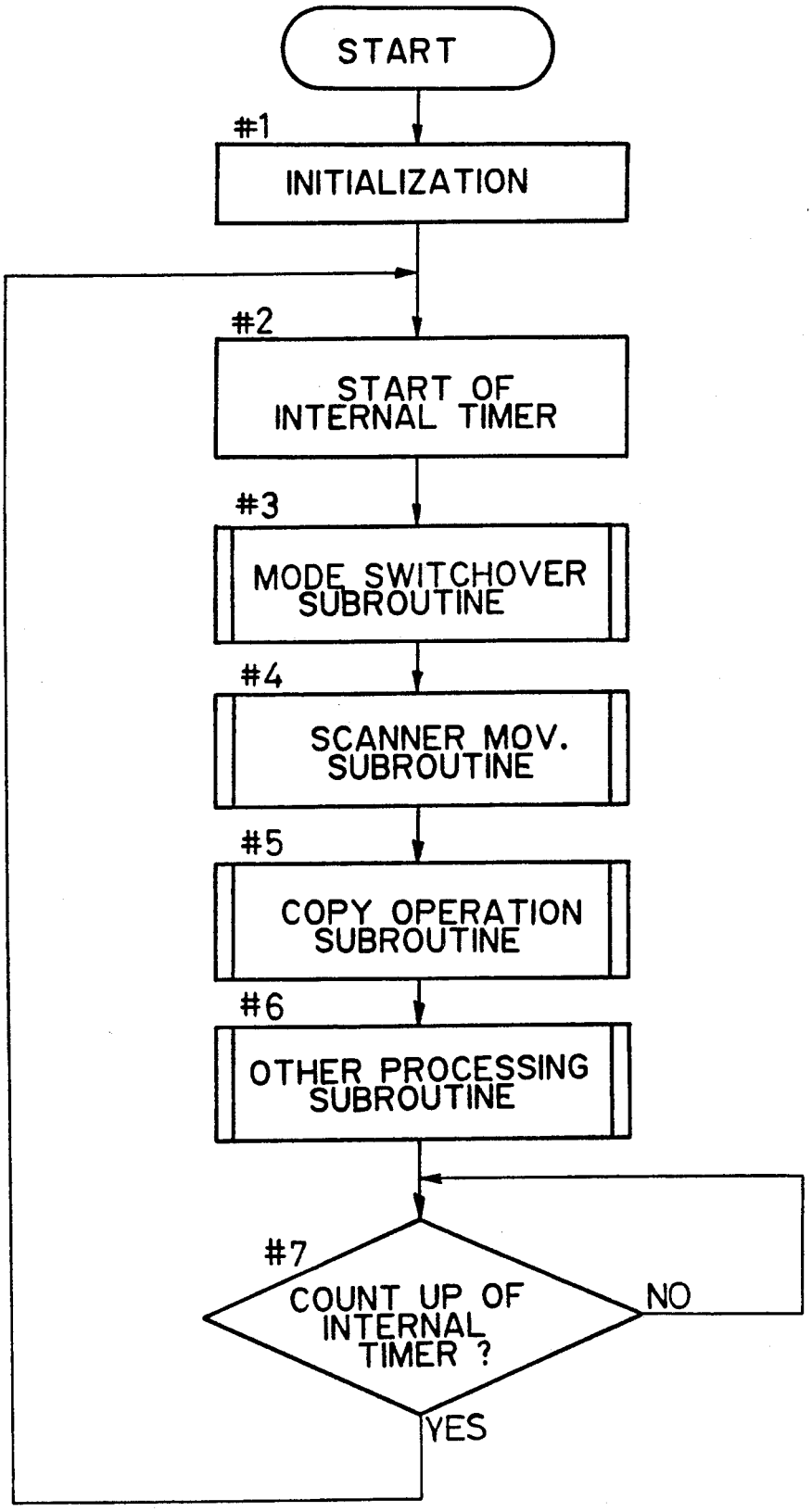
FIG. 5 is a flow chart showing a main routine of controls.

FIG. 5 shows the main control routine processed by the CPU 61. When the power supply of the CPU 61 is made on and the reset is released, following steps are executed: in step #1, initial setting such as setting of registers or clearance of the RAM are performed; in step #2, an internal timer is started which designates the time for a routine; in step #3, a subroutine is called which performs a switchover process between the mirror scan mode and the LDC mode; in step #4, a scanner movement subroutine is called in which the mirror scanner 15 is moved to a regular position in the LDC mode or is returned to the original home position. Furthermore in steps #5 and #6, copying operation subroutine and other processing subroutines are called in order, finally after the counting up of the internal timer is checked, the operation process returns to step #2.

Figure 6:
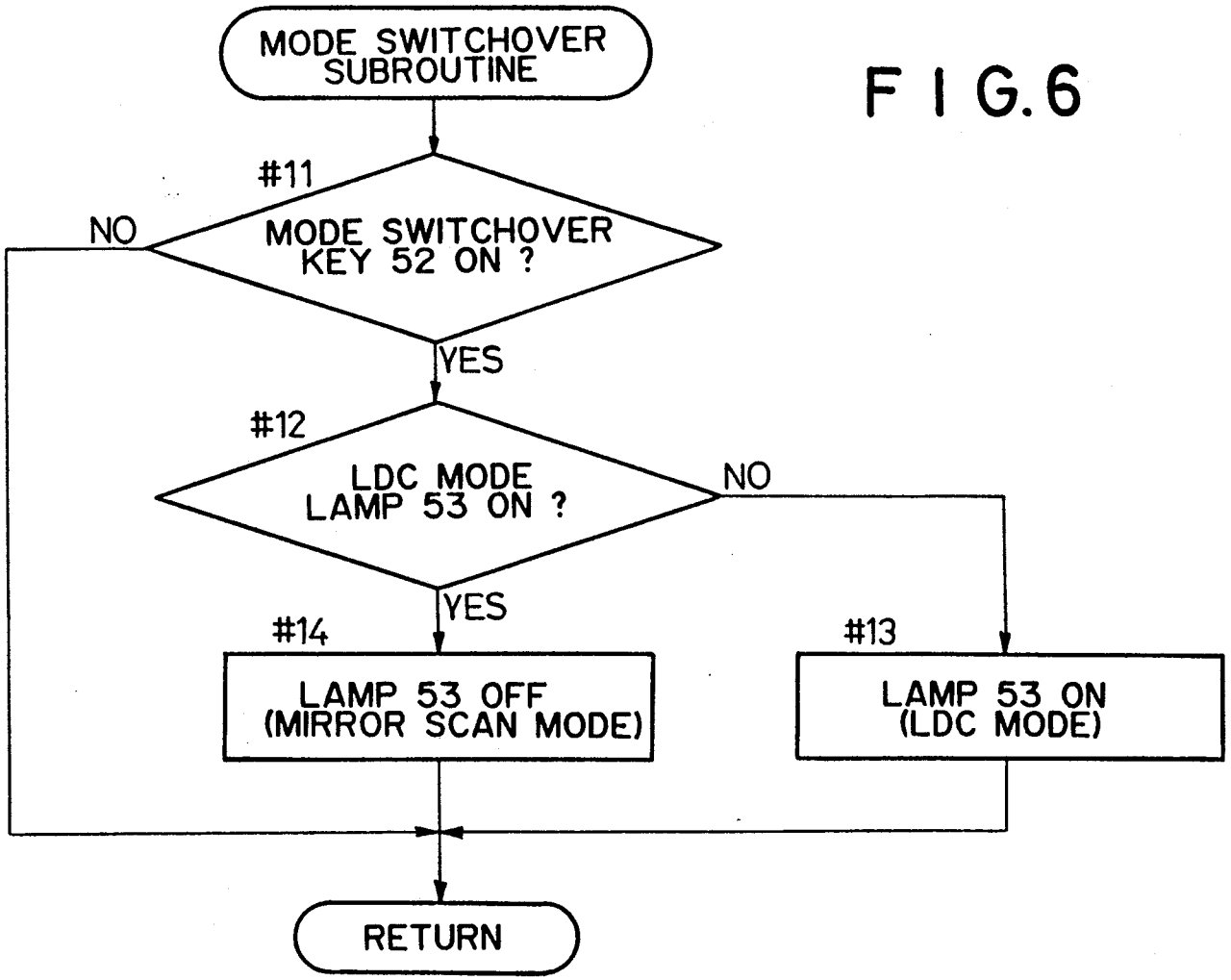
FIG. 6 is a flow chart showing a mode switchover subroutine.

FIG. 6 shows a mode switchover subroutine. In step #11, it is checked whether the switchover key 52 is turned on or not. When the key 52 is turned on, the operation proceeds to step #12 and it is checked whether the LDC mode indication lamp 53 is on or not. When the lamp 53 is off, it means that the mirror scan mode has been set. The control operation proceeds to step #13 to make the lamp 53 on; then the operation mode is switched from the mirror scan mode to the LDC mode. If the lamp 53 is on in step #12, it means that the LDC mode has been set. The control operation proceeds to step #14 to make the lamp 53 off; then the operation mode is switched over from the LDC mode to the mirror scan mode.

Figure 7:
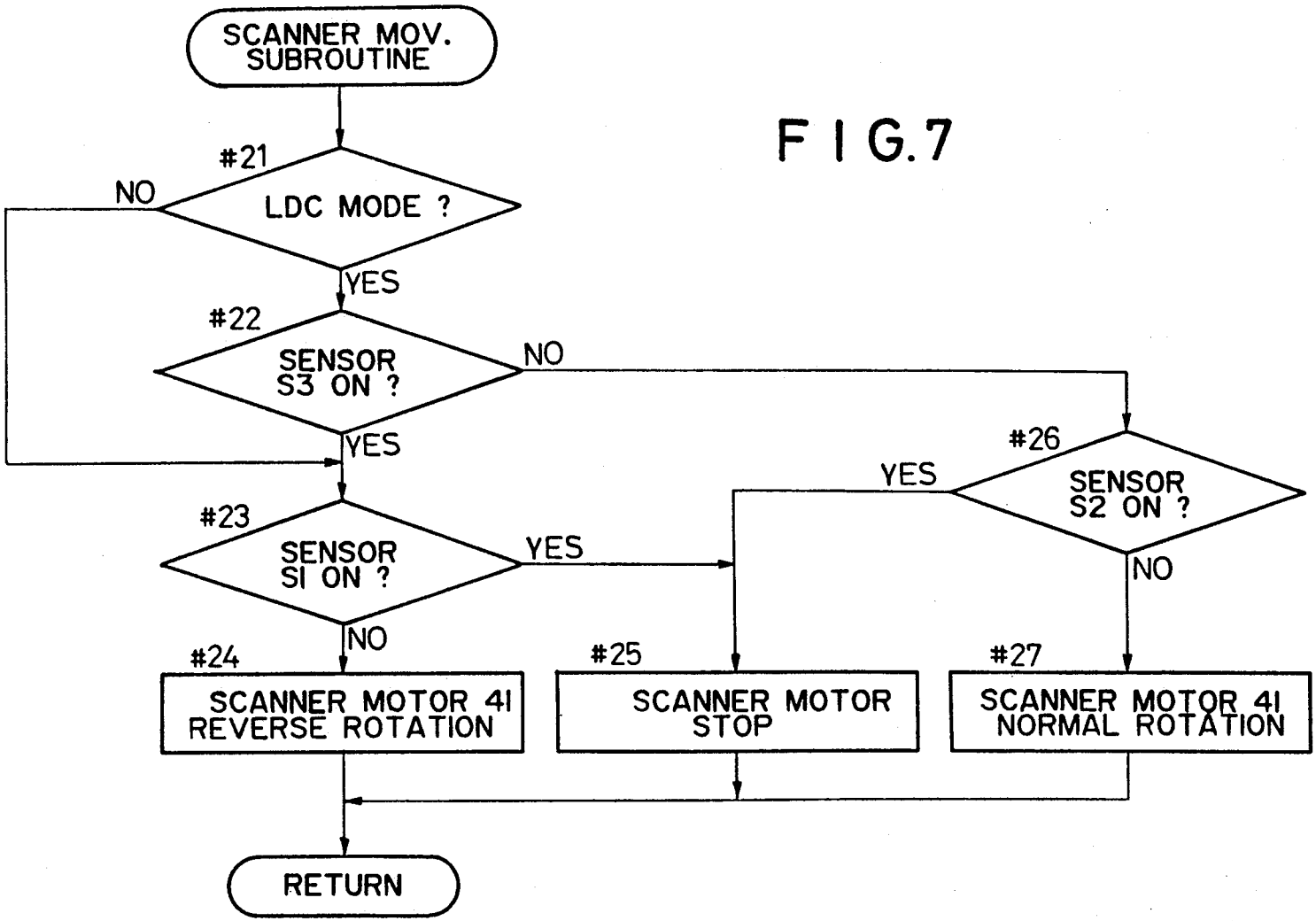
FIG. 7 is a flow chart showing a scanner movement subroutine.

FIG. 7 shows a scanner movement subroutine. In step #21, it is judged whether the mode is in the LDC mode or not based on the on/off condition of the lamp 53. When the mode is not in the LDC mode, the control operation proceeds to step #23. When the mode is in the LDC mode, the operation is shifted to step #22. In step #22, it is judged whether the automatic document feeder 3 is opened or not with the signal from the sensor S3. When the automatic document feeder 3 is opened, the scanner motor 41 shall be rotated in the reverse direction until the home position sensor S1 detects the mirror scanner 15 (steps #23 and #24). When the sensor S1 detects the mirror scanner 15 in step #23, it means that the mirror scanner 15 has been returned to the home position, then the control operation proceeds to step #25 to stop the scanner motor 41. As described in the above, if the automatic document feeder 3 is opened in the LDC mode, the mirror scanner 15 is returned to the home position.

When the automatic document feeder 3 is closed in step #22, the scanner motor 41 is rotated in a normal direction until the LDC regular position sensor S2 detects the mirror scanner 15 (steps #26 and #27). When the sensor S2 detects the mirror scanner 15 in step #26, it means that the mirror scanner 15 has reached the regular position in the LDC mode, then the operation proceeds to step #25 to stop the scanner motor 41. With the arrangement as described in the above, when a mode is changed from the mirror scan mode to the LDC mode or when the automatic document feeder 3 is once opened and then closed in the LDC mode, the mirror scanner 15 in the home position is automatically moved to the regular position for the LDC mode.

The above-mentioned procedure is more convenient than a procedure in which the mirror scanner 15 in the regular position for the LDC mode is returned to the home position and at the same time the LDC mode is returned to the mirror scan mode.

The present invention is not limited to the above-mentioned embodiment and it can be executed in various ways. For example when the automatic document feeder 3 is opened in the LDC mode, the mirror scanner 15 is returned to the home position, but it can be moved to any place except the light transmission part of the platen glass 2.

When the automatic document feeder 3 is opened, incident external light can be controlled by driving the first movable mirror 14 to change its direction not to make the incident external light reflect towards the photosensitive member. The following constructions are also effective in preventing the influence of external light: the back side of the fourth fixed mirror, which is designed to be movable for a short distance, is made irreflective, and the mirror is driven to rotate 180 degrees; the mirror is driven to move to a place where the reflected light does not strike on the photosensitive member; when the part at which the mirror scanner 15 is positioned for the LDC mode is covered with a member such as an original holder, etc., the similar process as mentioned in the above will be executed. Moreover, a lock means is provided to keep a closed state for preventing a covering member from being opened carelessly. When the covering member is to be opened, if at first a preliminary operation such as the release from a locked state by the lock means is performed, at the moment when such a preliminary operation is detected the similar process to the case where the covering member is opened.

The present embodiment has two kinds of modes, a mirror scan mode and an LDC mode, but in the case where a copying machine has the LDC mode only, for example an original table moving type in which an original is moved together with the original table, or an original conveying type in which an original itself is conveyed with an original conveying means, the present invention is still useful.

Furthermore irrespective of the fact that whether exposure is performed moving an original or not, the present invention is also useful for a flash exposure system in which copying operation is done in the state where the optical system for leading an original image to a photosensitive member is in a stationary state.

According to the present invention in the LDC mode, when the automatic document feeder is to be opened or a preliminary operation for it is performed, the mirror scanner which has been moved to the regular position located at the light transmission part of the platen glass and is stopped there is automatically brought to a place of refuge excepting the light transmission part of the platen glass, so that such a case that a covering member is opened and an external light incident on the platen glass is picked up by the mirror scanner and reaches a photosensitive member can be avoided without any special control; therefore the uneven charging which leads to the unevenness of image density caused by the occurrence of local light-fatigue is dissolved. Moreover the arrangement as described in the above can be realized simply and economically.

When the above-mentioned place of refuge is the home position for the mirror scan mode, if the copy in the mirror scan mode is to be performed in the next step, the operation to bring back the mirror scanner to the home position can be saved, which makes the first copy earlier by saving of time needed for the return operation to the home position.

What is claimed is:

1. A copying machine comprising:
a light transmission part for leading an original image to a photosensitive member;
a covering means for preventing a light incident from outside into the said light transmission part;
a photosensitive member for forming a latent image of the original;
an optical means being capable of moving to a first position for leading a light passing through said light transmission part to said photosensitive member and to a second position for not leading the light passing through the light transmission part towards said photosensitive member;
a driving means for moving said optical means to the first and the second positions;
a detection means for detecting the open/close operation of said covering means; and
a control means for controlling said driving means to move said optical means to the second position when said detection means detects opening of said covering means.

2. A copying machine according to claim 1, wherein said covering means comprises an original conveying device for conveying the original.

3. A copying machine according to claim 1, further comprising a second control means for controlling said driving means to move said optical means to the first position again when it is detected that said covering means is closed.

4. A copying machine according to claim 1, further comprising a lock means for making said covering means be in a locked state so that said covering means cannot be opened by improper handling, wherein said detection means detects the open/close operation of said covering means by detecting whether said lock means is in a locked state for keeping said covering means in a closed state or it is in a released state where opening is possible.

5. A copying machine comprising:
a platen glass for placing an original for copying;
a photosensitive member for forming an electrostatic latent image;
an original conveyance means for conveying an original onto said platen glass and for discharging it from said platen glass, and being freely opened and closed against said platen glass, and covering said platen glass for preventing a light incident from the outside;
an optical means having a plurality of movable optical elements being capable of operating in a first mode and in a second mode, said optical means leading an image of an original on said platen glass to said photosensitive member keeping each optical element in a stationary state at each regular operating position in the first mode, and leading the image of the original to said photosensitive member in moving at least one optical element in the second mode;
a detection means for detecting the open/close operation of said original conveyance means;
a mode selection means for selecting the first mode or the second mode; and
a control means for moving at least one of the optical elements from a regular operating position to an inoperative position when said original conveyance means is opened in the first mode.

6. A copying machine according to claim 5, wherein said control means, in the state where the second mode is selected and when the optical elements are in a waiting period, makes the optical elements wait in the first position at which the light incident from the outside is not led to said photosensitive member irrespective of the open/close condition of said original conveyance means.

7. A copying machine according to claim 6, wherein said control means, in the state where the first mode is selected and when said original conveyance means is released, makes the optical elements move to the first position, the similar position to the one where the optical elements are in a waiting state in the second mode.

8. A copying machine according to claim 5, further comprising a second control means for moving each optical element to each regular position in the state where the first mode is selected and when the closure of said original conveyance means is detected.

9. A copying machine according to claim 7, further comprising a second control means for controlling a selection means to select the second mode when the optical elements are moved to a first position with opening operation of said original conveyance means.

10. A copying machine comprising:
a platen glass for placing an original for copying;
a photosensitive member for forming an electrostatic latent image;
an original conveyance means for conveying an original onto said platen glass and for discharging it from said platen glass, and being freely opened and closed against said platen glass, and covering said platen glass for preventing alight incident from the outside;
an optical means having a plurality of movable optical elements being capable of operating in a first mode and in a second mode, said optical means leading an image of an original on said platen glass to said photosensitive member keeping each optical element in a stationary state at each regular operating position in the first mode, and leading the image of the original to said photosensitive member in moving at least one optical element in the second mode;
a detection means for detecting the open/close operation of said original conveyance means;
a mode selection means for selecting the first mode or the second mode; and
a control means for moving at least one of the optical elements from a regular operating position to an inoperative position when said original conveyance means is opened in the first mode wherein one of the optical elements is reversed by said control means when said original conveyance means is released in the state where the first mode is selected.

11. A copying machine comprising:
a platen glass for placing an original for copying;
a photosensitive member for forming an electrostatic latent image of the original;
an original conveyance means for conveying the original onto said platen glass and for discharging it from said platen glass, being freely opened and closed against said platen glass, and for covering said platen glass in a closed state for preventing a light incident from the outside;
an optical means having a mirror scanner for scanning the original in two modes, a first mode for providing an image of the original to said photosensitive member by moving the original on said platen glass across the mirror scanner when the mirror scanner is stationary and a second mode for providing the image of the original to said photosensitive member by moving the mirror scanner across the original when the original is held stationary on the platen;

a driving means for moving the mirror scanner;

a detection means for detecting an open/close operation of said original conveyance means;

a mode selection means for selecting the first mode or the second mode; and a control means for controlling said driving means to move the mirror scanner from a regular position to a position not leading a light incident from the outside to said photosensitive member in detecting the opening operation of said original conveyance means in the state where the first mode is selected.

12. A copying machine according to claim 11, further comprising a second control means for controlling said driving means to move each optical element to each regular operating position when the closure of said original conveyance means is detected in the first mode.

13. A copying machine according to claim 11, wherein said control means makes the mirror scanner be on stand by at the first position where the light incident from the outside is not led to said photosensitive member independent from the open/close condition of said original conveyance means and in the state where the second mode is selected and the scanner is in a waiting period.

14. A copying machine according to claim 13, wherein said control means makes the optical elements move to the first position which is similar to the stand by position in the second mode when said original conveyance means is opened in the state where the first mode is selected.

15. A copying machine according to claim 14, further comprising a second control means for controlling said mode selection means to select the second mode when the optical elements are moved to the first position with the releasing operation of said original conveyance means.

16. A copying machine having a light transmission part for taking in an original image into the inside of the copying machine, a cover means for preventing a light incident from the outside into said light transmission part, and a movable optical means capable of moving to an operable position for leading a light passing through said light transmission part to a photosensitive member, and of moving to an inoperable position for not leading a light to the photosensitive member, a method comprising the steps of:

detecting an opening operation of said cover means, and moving said optical means to the inoperable position.

17. A copying machine having a platen glass for placing an original for copying, an original conveyance means for conveying and discharging the original onto or from said platen glass and being freely opened and closed against said platen glass, a plurality of optical elements, a first mode for leading an original image on said platen glass to a photosensitive member in keeping each element at each regular operating position, and a second mode for leading the original image on said platen glass to the photosensitive member in moving at least one optical element, a method comprising the steps of:

detecting the release of said original conveyance means, judging the first mode, and moving at least one optical element to an inoperable position not leading the light to the photosensitive member.

* * * * *